US005480057A

United States Patent [19]

Papaluca

[11] Patent Number: 5,480,057

[45] Date of Patent: Jan. 2, 1996

[54] BULK CONTAINER HAVING FLEXIBLE INNER CONTAINER AND RIGID OUTER CONTAINER

[75] Inventor: Vincent Papaluca, Dandenong, Australia

[73] Assignee: Entapack Pty. Ltd, Dandenong, Australia

[21] Appl. No.: 175,418

[22] PCT Filed: Jun. 11, 1992

[86] PCT No.: PCT/AU92/00273

§ 371 Date: Dec. 27, 1993

§ 102(e) Date: Dec. 27, 1993

[87] PCT Pub. No.: WO93/00268

PCT Pub. Date: Jan. 7, 1993

[30] Foreign Application Priority Data

Jun. 27, 1991 [AU] Australia ..... PK6925

[51] Int. Cl.[6] ..... B65D 90/04

[52] U.S. Cl. ..... 220/403; 220/601; 220/661

[58] Field of Search ..... 220/601, 403, 220/661, 465, 461; 222/105, 185

[56] References Cited

U.S. PATENT DOCUMENTS

| | | | |
|---|---|---|---|
| 3,169,690 | 2/1965 | Scholle | 220/403 |
| 3,173,579 | 3/1965 | Curie et al. | 222/105 |
| 3,233,817 | 2/1966 | Casady | 220/403 |
| 3,363,807 | 1/1968 | Powell | 222/105 |
| 4,421,253 | 12/1993 | Croley | 222/105 |
| 4,516,692 | 5/1985 | Croley | 220/403 |
| 4,850,506 | 7/1989 | Heaps, Jr. et al. | 220/403 |
| 4,890,772 | 1/1990 | Heuberger et al. | 222/185.1 |
| 5,156,295 | 10/1995 | Gordon et al. | 222/105 |
| 5,199,594 | 4/1993 | Obara et al. | 220/403 |

FOREIGN PATENT DOCUMENTS

| | | |
|---|---|---|
| 84813 | 9/1975 | Australia . |
| 3785385 | 7/1985 | Australia . |
| 4225485 | 11/1985 | Australia . |
| 8141387 | 5/1988 | Australia . |

*Primary Examiner*—Stephen J. Castellano
*Attorney, Agent, or Firm*—Hovey, Williams, Timmons & Collins

[57] ABSTRACT

A collapsible container is provided in which there is a flange extension (8) from the outlet spout (5) to the lower corner of the container beneath the spout to hold the collapsible container in the corner of the rigid outer container (11) while the container is being filled.

8 Claims, 2 Drawing Sheets

BULK CONTAINER HAVING FLEXIBLE INNER CONTAINER AND RIGID OUTER CONTAINER

BACKGROUND OF THE INVENTION

1. Field of the Invention

This invention relates to a flexible container for fluids.

2. Discussion of the Prior Art

Flexible containers for fluids are known in which there is an outer substantially rigid container and an inner collapsible container for fluids. The inner collapsible container can be filled with fluid and the contents can be dispensed without the need for air to enter the inner container thereby to avoid oxidation and deterioration of the contents. Wine and other fluids are housed in what have become known as bag-in-box containers.

Containers are also known for industrial type application to package larger quantities of fluids. For example, bulk containers are used to hold in the order of 1000 liters of fluid or paste. In these containers there is often a pallet such as a wooden pallet or the like supporting an outer substantially cubular rigid container which may be made of metal, timber or cardboard for example. The inner collapsible container may be made of polymeric film such as polyethylene and may include several layers of film to provide strength and oxygen barrier characteristics as required.

Such containers may include an inlet towards the top through which fluids may be passed to the collapsible container and an outlet welded to a side wall of the collapsible container and including a spout to extend through an opening in a wall of the outer container and to which the contents can be dispensed. However, in larger containers of this type it has been found that leakage often occurs where the outlet spout is welded to the flexible container.

OBJECTS AND SUMMARY OF THE PRESENT INVENTION

Analysis of the problem has revealed that substantial forces are created at the weld due to the pressure caused by the contents of the flexible container particularly during transportation.

An object of the present invention is to minimize the risk of leakage in the manner outlined.

According to the present invention there is provided a collapsible container for fluids. The collapsible container is adapted to be housed in an outer substantially rigid container which includes a base for supporting the collapsible container, a plurality of side walls to support the collapsible container when filled and through one of those side walls an outlet opening. The rigid container may be supported on a pallet or the like as is known in the art and it may be made of timber, carboard, metal or other suitable material.

The collapsible container of the present invention may be made of any suitable film material or laminated films of material as is known in the art. A polypropylene or polyethylene film is particularly suitable for this purpose. The collapsible container is preferably shaped generally to correspond with the shape of the rigid container in which it is to be housed so that when full it will extend to and press against the walls of the rigid container to be supported thereby. Preferably the collapsible container is marginally greater in size than the rigid container to ensure that the collapsible container does not need itself to support the weight of the contents when in use.

The collapsible container may include a fluid inlet preferably on its upper wall and through which fluid may be passed into the collapsible container. The inlet may include an inlet spout to extend through an inlet opening in the collapsible container and an inlet flange by which the inlet spout may be joined to the collapsible container. An inlet cap may be provided by which the inlet spout may be closed or opened. This may include for example a screw threaded cap.

The inlet may be made of any suitable material. A suitable material is polyethylene. It is desirable that the material of the inlet spout and the material of the collapsible container be compatable for joining, preferably by a welding technique as is known in the art.

The collapsible container of the present invention includes an outlet means. The outlet means of the present invention includes an outlet spout which may extend through the outlet opening in a wall of the rigid container. An outlet flange is provided whereby the outlet means may be joined to the collapsible container wall. The outlet flange of the present invention includes a substantially rigid flange extension that in use extends from the outlet opening to a position substantially adjacent the junction of the side wall and the bottom wall of the rigid container. The wall of the collapsible container is joined to the outlet flange and flange extension at least substantially adjacent the perimeter thereof for a purpose more fully discussed below. The flange and flange extension may be of any suitable shape and size necessary to extend to the position described. It may be provided as a framework or be continuous to provide a holding portion or portions adjacent the junction of the side and bottom walls in use. It also includes a spacing portion between the holding portion and flange to locate the holding portion in that position.

The film of the collapsible container may extend across the outlet spout in a manner known in the art whereby to seal the outlet means until specifically opened for dispensing of the fluid contents of the flexible container.

The outlet spout may be provided with an outlet cap which may be screw threaded or otherwise affixed thereto.

BRIEF DESCRIPTION OF THE DRAWING FIGURES

An example of the apparatus of the present invention is shown in part in the drawings annexed, wherein.

DETAILED DESCRIPTION OF THE PREFERRED EMBODIMENT

Figure 1:
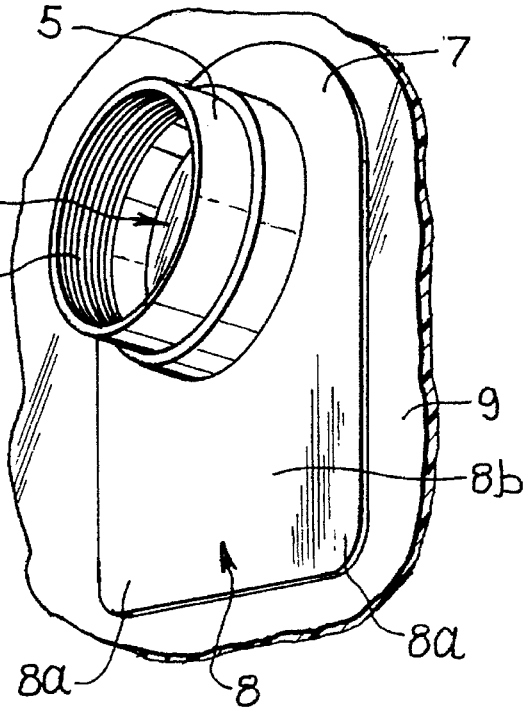
FIG. 1 is a fragmentary perspective view of an outlet of a collapsible container constructed in accordance with the preferred embodiment of the invention.

FIG. 1 shows an outlet means of the present invention. It includes an outlet spout shown generally at 5 including a screw threaded portion 6 to which a covering cap 15 (shown in FIG. 3) can be applied. There is shown a flange 7 and flange extension 8 affixed to flexible film 9 of a collapsible container. The extension 8 may include a holding portion shown generally at 8*a* and a spacing portion 8*b*.

Portion 10 extends across the spout opening to provide a seal until the apparatus is opened.

Figure 2:
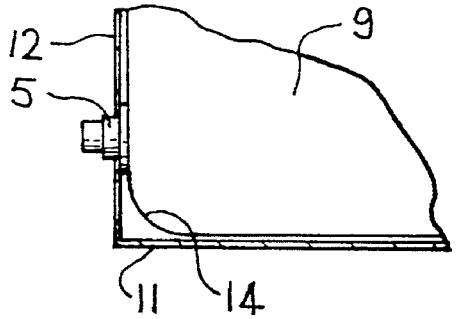
FIG 2 (PRIOR ART)
FIG. 2 is a fragmentary side elevational view of a container assembly representative of the prior art.
Figure 3:
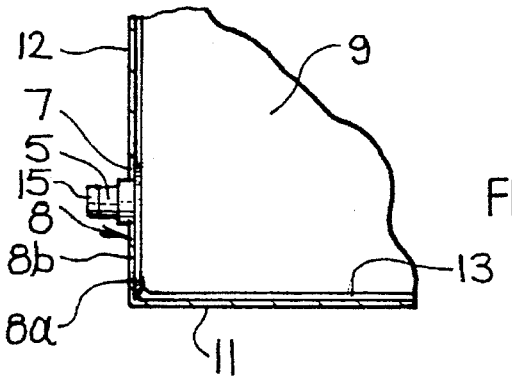
FIG. 3 is a fragmentary side elevational view of a container assembly constructed in accordance with the preferred embodiment, illustrating a cap secured in the outlet.

FIGS. 2 and 3 show in cross section the junction bottom and side walls of a rigid container with bottom wall 11 and side wall 12 with spout 5 projecting therefrom. Within the container is shown collapsible container 9.

Figure 4:
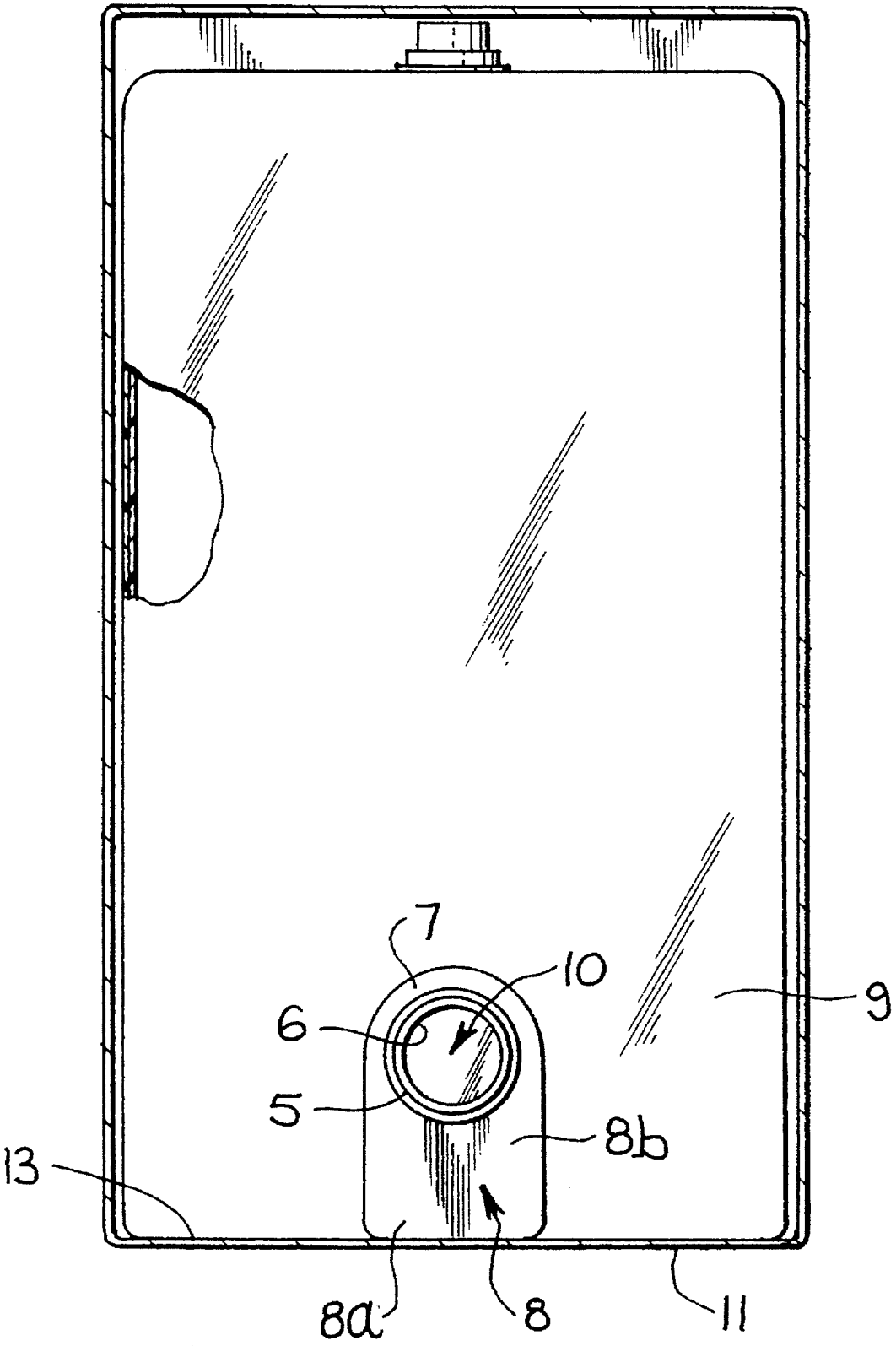
FIG. 4 is a front elevational view of a container assembly constructed in accordance with the preferred embodiment, illustrating a collapsible container housed in an outer rigid container.

In FIG. 4 flange extension 8 will be noted. Flange extension 8 extends to a location 8*a* adjacent the corner of side wall 12 and bottom wall 11 of the rigid container. This pulls the bottom wall 13 of the flexible container 9 into the corner of the rigid container as shown in FIG. 3.

This can be compared with the arrangement shown in FIG. 2 where a flange extension 8 is omitted. In that arrangement it is common for the flexible container 9 to form a wall between the outlet and the bottom wall 11 without extending into the corner as is shown generally at 14.

It will be seen then that the invention provides a simple and practical means of pulling the flexible container into a position adjacent the corner of the side wall and the bottom wall beneath the outlet spout. This is very difficult to achieve in the prior art. Before filling the collapsible bag is placed loosely in the rigid container with the spout in the outer opening. As it is filled the plastic moves to accommodate the contents but the weight of the contents forcing down onto the bottom wall provides substantial resistance against the bag expanding out evenly into the corners of the rigid container. Attempts have been made in the past to inflate the flexible container before filling. Even so the tendency is for the corners to be shaped generally shown in FIG. 2.

In locations other than adjacent the outlet spout, forces applied to the collapsible container as a result of it being rounded at the corners is of little consequence. However, the substantial forces that are generated adjacent the spout particularly when the container is transported tends to tear the flexible container away from the outlet flange. By use of the flange extension of the present invention the flexible container is automatically moved into the corner of the side wall and bottom wall adjacent the outlet spout so that the forces hereindescribed are not generated in that locality. This limits the breaking force of the container against the flange and avoids the difficulties herein described.

It will be appreciated that many variations and modifications may be made to the above described construction and arrangement of parts without departing from the spirit of the present invention.

I claim:

1. A bulk container including an inner collapsible container and an outer rigid container in which the inner collapsible container is housed, the rigid container including a bottom wall for supporting the collapsible container, a plurality of side walls to support the collapsible container when filled, and an outlet opening through one of the side walls, said collapsible container being provided with an outlet spout adapted to extend through the outlet opening of the rigid container, an outlet flange joining said spout to said collapsible container, and a substantially rigid flange extension being an extension of said outlet flange and extending from a position adjacent said outlet opening to a position adjacent the junction of the side wall and the bottom wall of the rigid container to hold a portion of the flexible container into the corner of the rigid container beneath said outlet while the collapsible container is being filled, wherein the lower edge of the flange extension contacts the bottom wall of the rigid container.

2. A container as claimed in claim 1, wherein said flange extension is integrally moulded with said flange.

3. A collapsible container as claimed in claim 2 wherein said outlet spout, said flange and said flange extension are polyethylene.

4. A container as claimed in claim 1, wherein said flange extension is located on the outer surface of the collapsible container and is welded thereto.

5. A container as claimed in claim 1, including an outlet cap affixed to said outlet spout.

6. A container as claimed in claim 1, wherein a portion of said collapsible container extends across said outlet spout to seal said spout from the contents of the container until pierced.

7. A container as claimed in claim 1, provided by a plurality of layers of polymeric film.

8. A collapsible container as claimed in claim 1, including a top wall having a sealable outlet for fluids.

* * * * *